US008210812B2

(12) United States Patent
Abdel-Messeh et al.

(10) Patent No.: US 8,210,812 B2
(45) Date of Patent: Jul. 3, 2012

(54) ADVANCED TURBULATOR ARRANGEMENTS FOR MICROCIRCUITS

(75) Inventors: William Abdel-Messeh, Middletown, CT (US); Frank Cunha, Avon, CT (US)

(73) Assignee: United Technologies Corporation, Hartford, CT (US)

( * ) Notice: Subject to any disclaimer, the term of this patent is extended or adjusted under 35 U.S.C. 154(b) by 272 days.

(21) Appl. No.: 12/344,776

(22) Filed: Dec. 29, 2008

(65) Prior Publication Data

US 2009/0104035 A1 Apr. 23, 2009

Related U.S. Application Data

(63) Continuation of application No. 11/388,815, filed on Mar. 24, 2006, now Pat. No. 7,513,745.

(51) Int. Cl.
*F01D 5/18* (2006.01)

(52) U.S. Cl. ..... 416/96 R

(58) Field of Classification Search ..... 416/96 R, 416/97 R

See application file for complete search history.

(56) References Cited

U.S. PATENT DOCUMENTS

| | | | | |
|---|---|---|---|---|
| 6,056,508 | A | 5/2000 | Johnson et al. | |
| 6,227,804 | B1 | 5/2001 | Koga et al. | |
| 6,290,462 | B1 | 9/2001 | Ishiguro et al. | |
| 6,641,362 | B1 | 11/2003 | Anding et al. | |
| 6,769,875 | B2 | 8/2004 | Tiemann | |
| 7,513,745 | B2 * | 4/2009 | Abdel-Messeh et al. | 416/96 R |
| 2003/0049125 | A1 | 3/2003 | Bolms et al. | |
| 2004/0096313 | A1 | 5/2004 | Harvey et al. | |
| 2006/0051208 | A1 | 3/2006 | Lee et al. | |

FOREIGN PATENT DOCUMENTS

| | | | |
|---|---|---|---|
| EP | 1136651 | A1 | 9/2001 |
| JP | 2003528246 | T | 9/2003 |
| WO | 01/71164 | A1 | 9/2001 |

* cited by examiner

*Primary Examiner* — Nathaniel Wiehe
(74) *Attorney, Agent, or Firm* — Bachman & LaPointe, P.C.

(57) ABSTRACT

A passageway is provided through which a cooling fluid flows in a first direction. The passageway has a plurality of trip strips positioned within the passageway. Adjacent one of the trip strips are oriented to converge towards each other at a first end to form an apex portion and to form a region in which turbulence is created. The apex portion is oriented at an angle with respect to the first direction.

17 Claims, 3 Drawing Sheets

ADVANCED TURBULATOR ARRANGEMENTS FOR MICROCIRCUITS

CROSS REFERENCE TO RELATED APPLICATION(S)

This application is a continuation of U.S. application Ser. No. 11/388,815, filed Mar. 24, 2006, entitled ADVANCED TURBULATOR ARRANGEMENTS FOR MICROCIRCUITS.

BACKGROUND OF THE INVENTION (1) Field of the Invention

The present invention relates to advanced turbulator arrangements for cooling microcircuits used in turbine engine components.

(2) Prior Art

Turbulation devices have been used in cooling passageways as a way of increasing the heat being transferred. Typically, the previous trip-strip turbulation designs have centered around the designs shown in FIGS. 1 and 2. As shown in FIG. 1, a cooling passageway 10 having cooling fluid flowing in the direction 12 have had a pair of trip strips 14 and 16 forming a chevron design with the apex 18 of the chevron being along the flow direction 12 and the symmetrical axis 20 being parallel to the flow direction 12.

Referring now to FIG. 2, there is shown an alternative prior art turbulation system having a cooling passageway 10' with a cooling fluid flowing in the direction 12'. As can be seen from this figure, a plurality of trip strips 14' are arranged at an angle less than 90 degrees with respect to the flow direction 12'.

The contours 22 in the embodiments of FIGS. 1 and 2 illustrate areas of higher turbulence in the coolant flow field, and therefore more heat transfer pick-up. The heat transfer enhancement relative to channel flow with smooth walls is about two to three times the heat transfer obtained from the smooth channel flow depending on the Reynolds number for the coolant flow. The enhancement shown in FIGS. 1 and 2 is only local and washes away from its peak value either at the junction or apex 18 of the trip strips 14 and 16 in the chevron arrangement of FIG. 1 or close to the wall in an angled trip strip arrangement as shown in FIG. 2.

It is therefore desirable to extend the heat transfer regions that usually occur at the trip-strip junctions, either with other trip strips or connecting walls.

SUMMARY OF THE INVENTION

In accordance with the present invention, there is provided a turbulation arrangement for a cooling passageway which extends the heat transfer region to substantially the entire cooling surface area.

In accordance with the present invention, a passageway through which a fluid flows in a first direction is provided. The passageway broadly comprises a plurality of trip strips positioned within the passageway, and adjacent ones of the trip strips are oriented to converge towards each other at a first end to form an apex portion and to form a region in which turbulence is created. The apex portion is at an angle with respect to the first direction.

Further, in accordance with the present invention, a part, such as a turbine engine component is provided. The part broadly comprises a passageway through which a fluid flows in a first direction, which passageway having a plurality of trip strips positioned therein. Adjacent ones of the trip strips are oriented to converge towards each other at a first end to form an apex portion and to form a region in which turbulence is created. The apex portion is preferably at an angle with respect to the first direction.

Other details of the advanced turbulator arrangements for microcircuits of the present invention, as well as other objects and advantages attendant thereto, are set forth in the following detailed description and the accompanying drawings, wherein like reference numerals depict like elements.

DETAILED DESCRIPTION OF THE PREFERRED EMBODIMENT(S)

Figure 1:
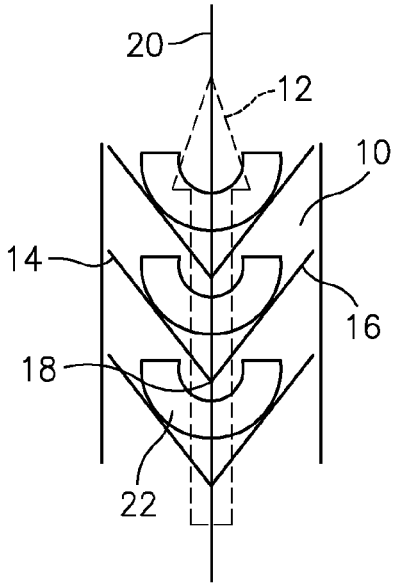
FIG. 1 (PRIOR ART)
FIG. 1 is a schematic representation of a prior art turbulation arrangement in a cooling passageway for increasing heat transfer.
Figure 2:
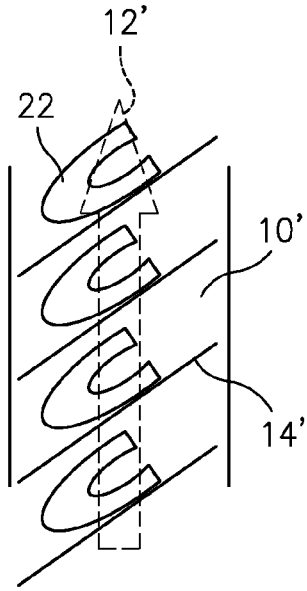
FIG. 2 (PRIOR ART)
FIG. 2 is a schematic representation of another prior art turbulation arrangement in a cooling passageway for increasing heat transfer.
Figure 3:
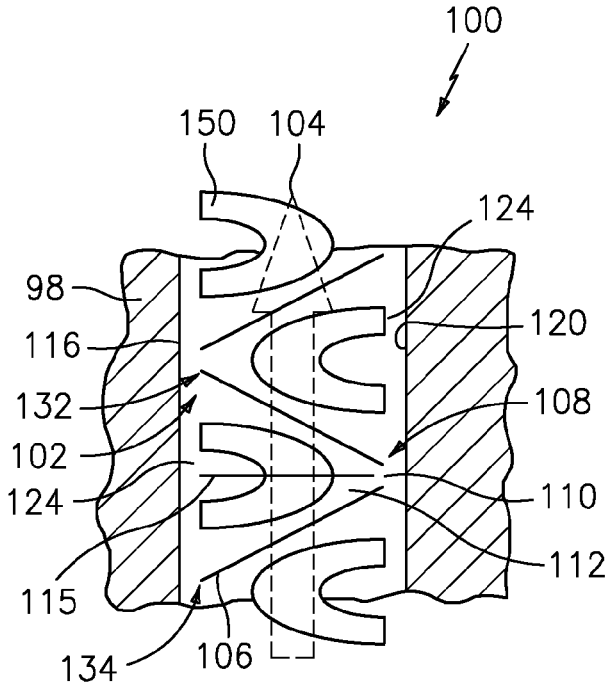
FIG. 3 is a schematic representation of a turbulation arrangement for a cooling passageway in accordance with the present invention.

The present invention relates to a cooling passageway having an improved turbulation arrangement. As shown in FIG. 3, the cooling passageway may be a portion of a cooling microcircuit (not shown) within a part 98, such as a turbine engine component.

Referring now to FIG. 3, there is shown a first turbulation arrangement 100 in accordance with the present invention. The turbulation arrangement 100 is provided within a passageway 102 in which a fluid, such as a cooling fluid, flows in a direction 104. The turbulation arrangement comprises a plurality of trip strips 106 arranged at an angle with respect to the flow direction 104. Adjacent ones of the trip strips 106 are arranged so that they converge towards each other and form an apex portion 108 with an opening 110 through which the cooling fluid enters a region 112 bounded by the adjacent ones of the trip strips 106. The apex portion 108 is preferably at an angle, preferably a right angle, with respect to the flow direction 104. A first region 112 in the passageway 102 may have an apex portion 108 adjacent a first wall 116, while a second region 112, adjacent to the first region 112, may have its apex portion 108 adjacent a second wall 120 opposed to the first wall 116.

Each trip strip 106 may be formed using any suitable technique known in the art. The trip strips 106 may be formed on the walls of the passageway 102 so as to wrap around the walls.

Figure 4:
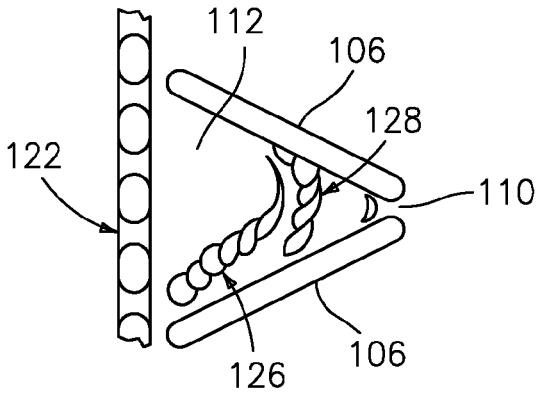
FIG. 4 is a schematic representation of the turbulation arrangement of FIG. 3 when fluid first forms two cells.

The regions 112 are preferably substantially triangularly shaped and are aligned along the flow direction 104. Each region 112 may have a plurality of vertices formed by the apex portion 108 and the trip strips 106 and the wall 116 or 120. Each region 112 preferably has an axis of symmetry 115 that is substantially perpendicular to the flow direction 104. If desired, as shown in FIG. 4, a series of cross over holes 122 may be provided at a base portion 124 of the region 112, which base portion 124 is at a second end of the region 112. The cross-over holes 122 offer a flow path by letting the flow through after or before turbulation. The second end of the region 112 is opposed to the first end where the apex portion 108 is located. The base portion 124 is preferably located near a wall 116, 120.

Figure 5:
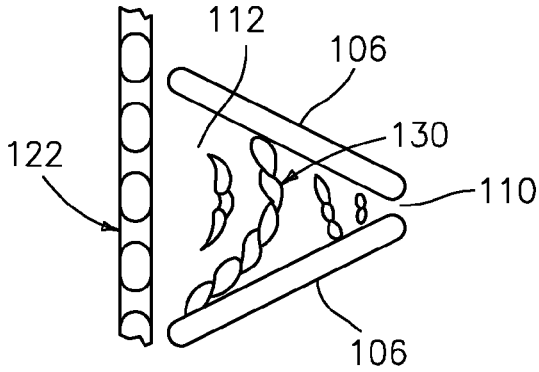
FIG. 5 is a schematic representation of the turbulation arrangement of FIG. 3 where the flows of the two cells merge.
Figure 6:
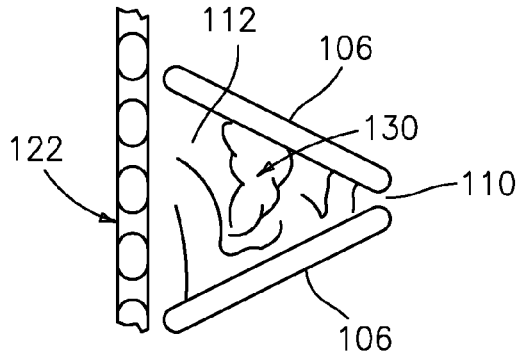
FIG. 6 is a schematic representation of the turbulation arrangement of FIG. 3 showing the fluid cell spreading throughout the region between the adjacent trip strips in the turbulation arrangement.

Referring now to FIG. 4, there is shown a representation of a turbulation arrangement in accordance with FIG. 3 having a region 112. As can be seen from the figure, as flow enters the region 112 through the apex opening 110, two fluid cells 126 and 128 are formed. As shown in FIG. 5, as more fluid enters the region 112, the two fluid cells 126 and 128 unite into a single cell 130. Finally, as shown in FIG. 6, the cell 130 spreads throughout the region 112 with the cell 130 occupying most of the area of the region 112. As a result, there is full turbulence within the region 112. Again, the turbulence comes from vortices that start at the apex opening 110 formed by the adjacent trip strips 106 and the junction points 132 and 134 formed by the trip strips 106 and the wall 116 or 120. The vortices are amplified from two out of the three vertices of the triangular shaped region 112 in such a way as to create turbulent cells all over the enclosed two dimensional area of the region 112 formed by the wall 116 and the trip strips 106.

Figure 7:
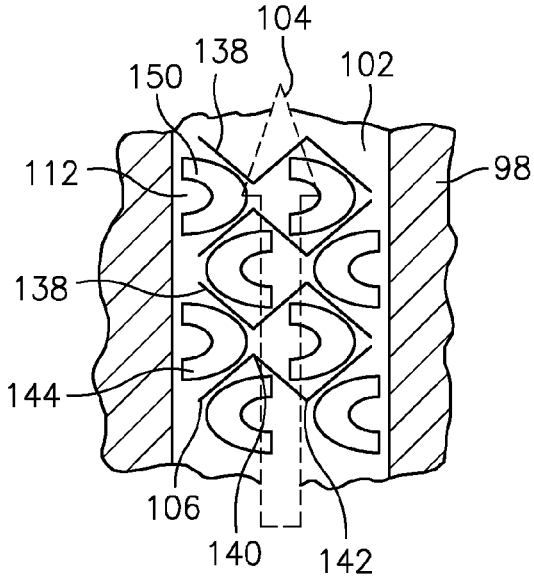
FIG. 7 is a schematic representation of an alternative turbulation arrangement in accordance with the present invention.
Figure 8:
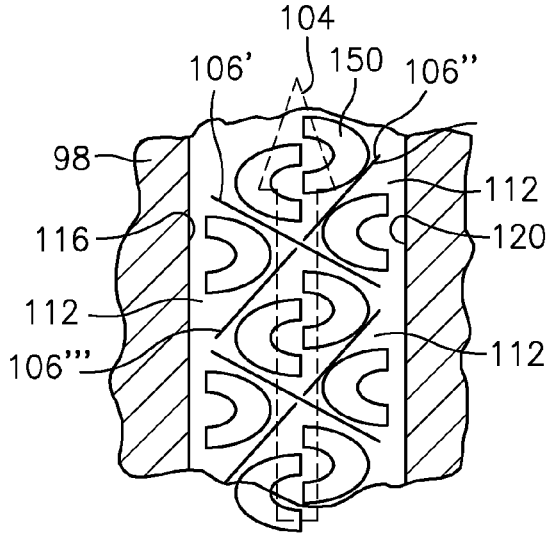
FIG. 8 is a schematic representation of yet another alternative turbulation arrangement in accordance with the present invention.

Extending this principle of creating turbulence, FIGS. 7 and 8 illustrate other turbulation arrangements with two or more active junctions to create areas of high heat transfer enhancement everywhere in a cooling passageway. The triangular junction points shown in the embodiments of FIGS. 7 and 8 may be in-phase or out-of-phase with each other. These high turbulence areas lead to an average heat transfer enhancement of two to three times not just locally, but also all over the entire two-dimensional enclosed area of the regions 112.

As shown in FIG. 7, a plurality of regions 112 may be formed by a plurality of rows 138 of trip strips 106 formed within the passageway 102. The rows 138 of trip strips 106 may be positioned along the flow direction 104. Each row 138 of trip strips 106 may comprise three trip strips 106 angled with respect to each other so as to form a pair of intersecting joints 140 and 142. In each row 138, a first of the trip strips may be at a first angle with respect to the flow direction 104, a second of the trip strips may be at a second angle with respect to the flow direction 104, and a third of the trip strips may be at a third angle with respect to the flow direction 104. If desired, each row 138 may have more than three trip strips. Further, if desired, adjacent ones of the trip strips 106 in a row 138 may form the joints 140 and 142 may be spaced from each other to form a gap 144. In this turbulator arrangement, a plurality of regions 112 may be aligned along an axis transverse to the flow direction 104.

Referring now to FIG. 8, a plurality of regions 112 may be formed by a diamond shaped turbulation arrangement wherein a first trip strip 106' extends from a point near the wall 116 to a point near the wall 120. The rest of each region 112 may be formed by two spaced apart trip strips 106" and 106'" which are at an angle that intersects the trip strip 106'. In this turbulation arrangement, a plurality of regions 112 may be aligned along an axis at an angle with respect to the flow direction 104.

The contours 150 shown in FIGS. 4, 7, and 8 illustrate the high turbulence areas created in each of the regions 112.

One of the advantages of the turbulation arrangements of the present invention is the creation of a more uniform heat transfer coefficient throughout the cooling passageway. This is because the average heat transfer enhancement is distributed throughout the entire area enclosed by the trip strips as opposed to having a peak enhancement just locally. As a result, a part, such as a turbine engine component, having a cooling passageway will experience less thermal mismatches. Part durability and life will improve with potentially less coolant flow, thus enhancing the performance of the part.

The turbulator arrangements of the present invention may be used in cooling passageways in a wide variety of turbine engine components including, but not limited to, blades, vanes, blade outer air seals, combustor panels, and any other part that contains a cooling passageway.

It is apparent that there has been provided in accordance with the present invention advanced turbulator arrangements for microcircuits which fully satisfy the objects, means, and advantages set forth hereinbefore. While the present invention has been described in the context of specific embodiments thereof, other unforeseeable alternatives, modifications, and variations, may become apparent to those skilled in the art having read the foregoing description. Accordingly, it is intended to embrace those alternatives, modifications, and variations as fall within the broad scope of the appended claims.

What is claimed is:

1. A passageway through which fluid flows in a first direction, said passageway comprising:

a plurality of trip strips positioned within the passageway for creating turbulence within a plurality of triangularly shaped regions within said passageway and for amplifying said turbulence so that a full turbulence is created within each said triangularly shaped region within said region;

adjacent ones of said trip strips being oriented to converge towards each other at a first end to form an apex portion of one of said triangularly shaped regions adjacent a first wall of said passageway and to form two of said side walls of said one of said triangularly shaped regions in which said full turbulence is created; and said apex portion being at a right angle with respect to said first direction and having a first opening through which said fluid enters said one triangularly shaped region and forms two fluid cells which unite into a single fluid cell as more fluid enters said opening and which single fluid cell spreads throughout the one triangularly shaped region and occupies most of the area of the one triangularly shaped region resulting in full turbulence within said one triangularly shaped region.

2. The passageway of claim 1, wherein said one triangularly shaped region has a base portion at a second end opposed to said first end, an axis of symmetry between said first end and said second end, and said axis of symmetry is at a right angle to said first direction.

3. The passageway of claim 2, wherein said base portion is located near a second wall of said passageway.

4. The passageway of claim 1, further comprising:

said passageway having said first wall and a second opposed wall; and said plurality of trip strips including a plurality of said trip strips positioned on said first wall and forming a plurality of said triangularly shaped regions along said first wall in the first direction and a plurality of said trip strips positioned on said second wall and forming a plurality of said triangularly shaped regions along said second wall.

5. The passageway of claim 4, wherein a first of said triangularly shaped regions has its apex portion adjacent said first of said walls and a second of said triangularly shaped regions adjacent to said first of said triangularly shaped regions has its apex portion adjacent said second of said walls.

6. The passageway of claim 1, wherein each said triangularly shaped region has said apex portion and two vertices formed by a pair of said trip strips and one of said first wall and a second wall of said passageway.

7. A passageway through which fluid flows in a first direction, said passageway comprising:

a plurality of trip strips positioned within the passageway for creating turbulence within a plurality of triangularly shaped regions in said passageway and for amplifying said turbulence so that a full turbulence is created within each said triangularly shaped region;

adjacent ones of said trip strips being oriented to converge towards each other at a first end to form an apex portion of one of said triangularly shaped regions and to form two of said side walls of said one of said triangularly shaped regions in which said full turbulence is created;

said apex portion being at an angle with respect to said first direction and having a first opening through which said fluid enters said one triangularly shaped region and forms two fluid cells which unite into a single fluid cell as more fluid enters said opening and which single fluid cell spreads throughout the one triangularly shaped region and occupies most of the area of the one triangularly shaped region resulting in full turbulence within said one triangularly shaped region;

said passageway having first and second opposed walls; and said plurality of trip strips forming a plurality of triangularly shaped regions aligned along an axis transverse to said first direction.

8. A passageway of through which fluid flows in a first direction, said passageway comprising:

a plurality of trip strips positioned within the passageway for creating turbulence within a plurality of triangularly shaped regions in said passageway and for amplifying said turbulence so that a full turbulence is created within each said triangularly shaped region;

adjacent ones of said trip strips being oriented to converge towards each other at a first end to form an apex portion of one of said triangularly shaped regions and to form two of said side walls of said one of said triangularly shaped regions in which said full turbulence is created;

said apex portion being at an angle with respect to said first direction and having a first opening through which said fluid enters said one triangularly shaped region and forms two fluid cells which unite into a single fluid cell as more fluid enters said opening and which single fluid cell spreads throughout the one triangularly shaped region and occupies most of the area of the one triangularly shaped region resulting in full turbulence within said one triangularly shaped region;

said passageway having a first wall and a second wall opposed to said first wall;

a plurality of said triangularly shaped regions between said walls; and said plurality of triangularly shaped regions being formed by a first trip strip extending from a first location near one of said walls to a second location near a second one of said walls and by a pair of spaced apart trip strips positioned at an angle which intersects the first trip strip.

9. A part comprising:

a passageway through which a fluid flows in a first direction;

said passageway having a plurality of trip strips positioned within the passageway;

adjacent ones of said trip strips being oriented to converge towards each other at a first end to form an apex portion of a triangularly shaped region within said passageway and to form two side walls of said triangularly shaped region in which turbulence is created;

said apex portion being at a right angle with respect to said first direction and having an opening through which said fluid enters said triangularly shaped region; and said triangularly shaped region having a base portion at a second end opposed to said first end, an axis of symmetry between said first end and said second end, and said axis of symmetry being perpendicular to said first direction.

10. The part according to claim 9, wherein said part comprises a turbine engine component.

11. The part according to claim 9, wherein said passageway comprises a cooling passageway in which a cooling fluid flows in said first direction.

12. The part of claim 9, wherein said base portion is located near a wall of said passageway.

13. The part of claim 9, further comprising:

said passageway having first and second opposed walls; and said plurality of trip strips forming a plurality of said triangularly shaped regions along the first direction.

14. The part of claim 13, wherein a first of said triangularly shaped regions has its apex portion adjacent a first of said walls and a second of said triangularly shaped regions has its apex portion adjacent a second of said walls.

15. The part of claim 9, wherein each said triangularly shaped region has said apex portion and two vertices formed by a pair of said trip strips and a wall of said passageway.

16. A part comprising:

a passageway through which a fluid flows in a first direction;

said passageway having a plurality of trip strips positioned within the passageway;

adjacent ones of said trip strips being oriented to converge towards each other at a first end to form an apex portion of a triangularly shaped region and to form two side walls of said triangularly shaped region in which turbulence is created;

said apex portion being at an angle with respect to said first direction and having an opening through which said fluid enters said triangularly shaped region;

said triangularly shaped region having a base portion at a second end opposed to said first end, an axis of symmetry between said first end and said second end, and said axis of symmetry being perpendicular to said first direction;

said passageway having first and second opposed walls; and said plurality of trip strips form a plurality of triangularly shaped regions aligned along an axis transverse to said first direction.

17. A part a passageway through which a fluid flows in a first direction;

said passageway having a plurality of trip strips positioned within the passageway;

adjacent ones of said trip strips being oriented to converge towards each other at a first end to form an apex portion of a triangularly shaped region and to form two side walls of said triangularly shaped region in which turbulence is created;

said apex portion being at an angle with respect to said first direction and having an opening through which said fluid enters said triangularly shaped region;

said passageway having a first wall and a second wall opposed to said first wall;

a plurality of said triangularly shaped regions between said walls; and said plurality of triangularly shaped regions being formed by a first trip strip extending from a first location near one of said walls to a second location near a second one of said walls and by a pair of spaced apart trip strips positioned at an angle which intersects the first trip strip.

* * * * *